United States Patent [19]

Okayasu

[11] Patent Number: 4,986,348

[45] Date of Patent: Jan. 22, 1991

[54] HEAT CONDUCTING DEVICE

[76] Inventor: Kenji Okayasu, 20-15, Mukai-machi, Gyoda-shi, Saitama-ken 361, Japan

[21] Appl. No.: 288,570

[22] Filed: Dec. 22, 1988

[30] Foreign Application Priority Data

Dec. 22, 1987 [JP] Japan ..... 62-324818

[51] Int. Cl.[5] ..... F28D 15/02

[52] U.S. Cl. ..... 165/104.24; 165/104.22; 417/208; 417/209

[58] Field of Search ..... 165/104.22, 104.24, 165/104.29; 417/207, 208, 209

[56] References Cited

U.S. PATENT DOCUMENTS

| | | | |
|---|---|---|---|
| 3,929,305 | 12/1975 | Sabol . | |
| 4,120,172 | 10/1978 | Pierce . | |
| 4,212,593 | 7/1980 | Chadwick . | |
| 4,573,330 | 3/1986 | van der Sluys . | |
| 4,625,790 | 12/1986 | Okayasu | 165/104.29 |
| 4,792,283 | 12/1988 | Okayasu . | |

FOREIGN PATENT DOCUMENTS

| | | | |
|---|---|---|---|
| 31679 | 2/1986 | Japan . | |
| 96395 | 5/1986 | Japan . | |
| 149792 | 7/1986 | Japan . | |
| 153488 | 7/1986 | Japan . | |
| 195283 | 8/1986 | Japan . | |
| 122170 | 8/1987 | Japan . | |
| 122171 | 8/1987 | Japan . | |
| 665200 | 5/1979 | U.S.S.R. | 165/104.24 |
| 897785 | 5/1962 | United Kingdom . | |
| 1293279 | 10/1972 | United Kingdom . | |

*Primary Examiner*—Albert W. Davis, Jr.

*Attorney, Agent, or Firm*—Cushman, Darby & Cushman

[57] ABSTRACT

A heat conducting device comprising a heat drive pump operated by using growth and contraction of steam bubbles due to heat, whereby the temperature of operating liquid condensed in a cooling portion of a heat pipe is made lower than that of the cooling portion of the heat pipe, and then the operating liquid is arranged to be returned to a heating portion of the heat pipe, as a result of which the heat pipe can be continuously operated.

12 Claims, 3 Drawing Sheets

HEAT CONDUCTING DEVICE

BACKGROUND OF THE INVENTION

1. Field of the Invention

The present invention relates to a heat pipe, and more particularly, to a heat pipe which can be used in a case where a conventional heat pipe cannot sufficiently accomplish the task in such a case where a great amount of heat is intended to be conducted, a case of a top heat mode, and a case where heat conduction is performed over a long distance. In actual, such case can be exemplified by that heat accumulated by a solar concentrator mounted on a roof of a house is conducted to an underground heat accumulation tank.

2. Description of the Prior Art

A heat pipe is widely used in various industrial fields since it can conduct heat several hundred times that conducted by a copper rod of the same form. A heat pipe vaporizes inside operating liquid in a high temperature portion thereof, the thus-formed steam is by the steam pressure difference transmitted to a low temperature portion thereof at which the steam is condensed so that heat corresponding to heat of vaporization is quickly transmitted from the high temperature portion to the low temperature portion. The thus-condensed liquid is returned to the high temperature portion by a capillary force generated in a portion called "wick" on the inner wall of the heat pipe.

However, if such a heat pipe is used in a top heat mode (the upper portion of the heat pipe is heated, while the lower portion of the same is cooled in a state where a gravity effects), if an excessive amount of heat is transmitted through the same, or if the same is used for transmitting heat over an excessively long distance, a phenomenon called "burnout" occurs, causing for the heat transmission to be limited or to be prevented. The reason for this lies in that the condensed operating liquid at the low temperature portion of the heat pipe is returned to the high temperature portion by the capillary force of the wick. In the case of the top heat mode, the liquid cannot be supplied to the heights which overcome the capillary force. In the case of the great amount of heat transmission or the long distance transmission, the return of the operating liquid to the high temperature portion can be excessively reduced due to the hydrodynamic resistance of the wick which serves to generate the capillary force. In order to overcome such problems, rotary type heat pipes or electroendosmose type heat pipes can be available. In the rotary type heat pipe, liquid is returned to the high temperature portion by using a centrifugal force generated by rotating the heat pipe formed in a tapered shape. On the other hand, in the electroendosmose type heat pipe, liquid is returned to the high temperature portion by an electric field force generated by applying a high voltage to the heat pipe. However, in these pipes, an individual power source or a electricity needs to be provided outside, or in the case of the long distance transmission, the structure becomes complicated and such type of pipes cannot be actually used.

SUMMARY OF THE INVENTION

An object of the present invention is to provide a heat conducting device capable of satisfactorily overcoming the above-described problems and with which the amount of the heat transmission can be controlled.

A heat conducting device according to the present invention comprises a heat drive pump operated by using growth and contraction of steam bubbles due to heat, whereby the temperature of operating liquid condensed in a cooling portion of a heat pipe is made lower than that of the cooling portion of the heat pipe, and then the operating liquid is arranged to be returned to a heating portion of the heat pipe, as a result of which the heat pipe can be continuously operated.

Another aspect of the present invention is a heat conducting device in which a heat source for the heat drive pump is arranged to be the heating portion of the heat pipe, and a cooler is disposed in a flow passage which connects an outlet of the cooling portion and an inlet of the heat drive pump for the purpose of making the temperature of the operating liquid condensed in the cooling portion of the heat pipe lower than that of the cooling portion.

A still further aspect of the present invention is a heat conducting device in which a flow distribution valve for dividing the flow and a conducting pipe for introducing the thus-divided operating liquid into an inlet of a radiator are provided at an outlet of the heat drive pump.

Other aspect of the present invention is a heat conducting device further comprising a cyclic flow passage including the heat pipe and a cyclic flow passage including the heat drive pump, wherein the two flow passages are connected to each other by a pressure conducting part such as diaphragm.

DESCRIPTION OF THE PREFERRED EMBODIMENTS

Figure 1:
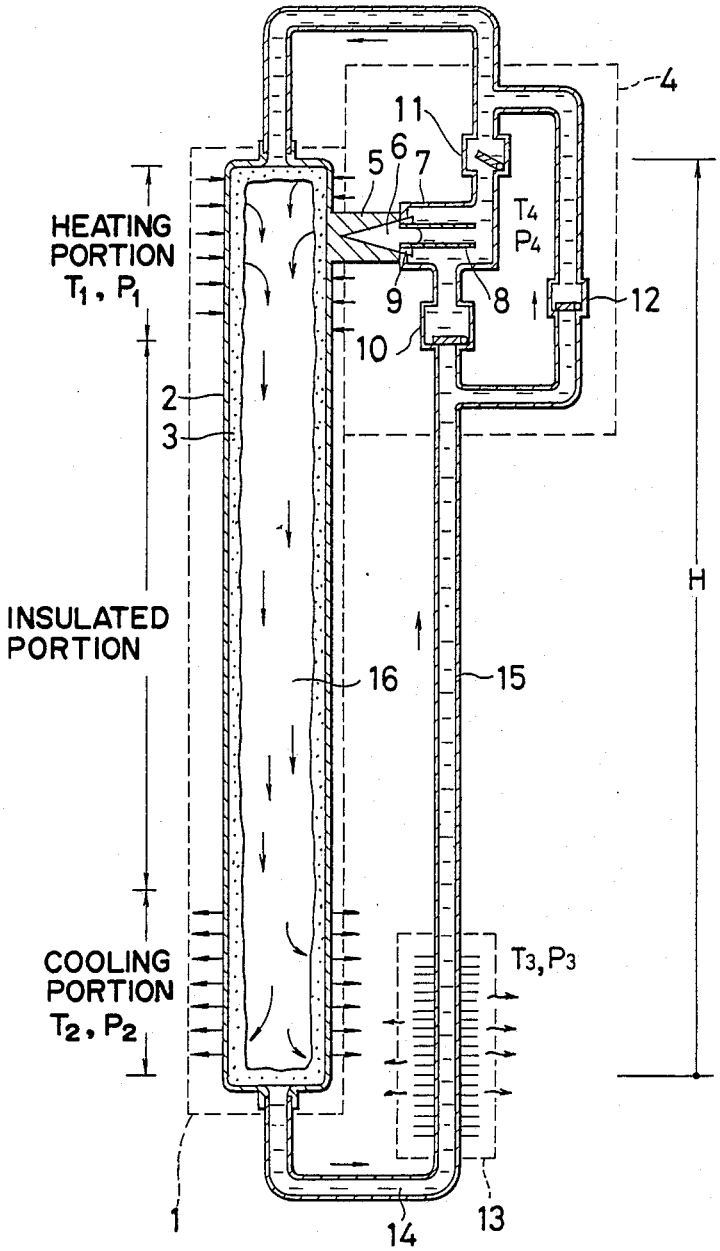
FIG. 1 is a schematic cross-sectional view of a heat conducting device according to the present invention.

FIG. 1 illustrates an embodiment of the present invention. The portion surrounded by a short dashed line 1 serves as a conventional heat pipe which is designed in such a manner that an wick 3 of a porous structure or a meshed structure for the purpose of effectively wetting operating liquid is put through the entire inner surface of a container 2 made of a thin and thermal-conductive material pipe such as copper.

The portion surrounded by a short dashed line 4 serves as a heat drive pump which includes a pump heating portion 5 made of a thermal-conductive material, and a conical liquid receptacle portion 6 therein.

The pump heating portion 5 is, integrally or in a similar manner, secured to the heat pipe heating portion of the container 2 for the purpose of establishing the same temperature between the pump heating portion 5 and the heat pipe heating portion of the container 2.

A gas-liquid converting chamber 7 comprises a thin pipe made of a stainless steel or the like having a poor thermal conductivity for the purpose of preventing heat transmission from the pump heating portion 5 to the liquid in the gas-liquid converting chamber 7. A condensing pipe 8 is secured in the converting chamber 7 and a plurality of capillary force generating fins 9 are disposed at the front end of this condensing pipe 8. The converting chamber 7 is connected to a suction side stopper valve 10 and a delivery side stopper valve 11 with conducting pipes respectively. An water hammer prevention stopper valve 12 is disposed in a conducting pipe which bypasses the main heat drive pump body.

The portion surrounded by a dashed line 13 serves as a return cooler which acts to further cool the operating liquid which has been condensed and gathered in a heat pipe cooling portion. The front end of the delivery stopper valve of the heat drive pump and the front end of the heat pipe heating portion, the lower end of the heat pipe cooling portion and the return cooler, and the return cooler and the heat drive pump suction side stopper valve are respectively connected by the conducting pipe 15. As a result, a closed circuit is formed so that the operating liquid 14 is circulated.

An operation of this embodiment will now be described.

The heat pipe according to the present invention is disposed vertically with respect to the ground and the height thereof is H. The top end of this heat pipe serves as a heating portion so that heat is transmitted to the lower end of the same. All of the conducting pipes, heat drive pump 4, wick 3 of the container 2 are filled with the operating liquid, while a space 16 other than the above-described members in the heat pipe is filled with the steam from the operating liquid.

When heat is applied to the heat pipe heating portion in this state, heat can be conducted to the operating liquid in the wick 3 through the thin wall of the container 2 so that the temperature of the operating liquid is raised and this operating liquid is vaporized from the surface of the wick 3 to the space in the heat pipe. On the other hand, since the temperature of the cooling portion is lower than that of the heating portion, a steam pressure difference is generated. As a result, the steam is rapidly moved from the heating portion to the cooling portion at which the steam is condensed on the surface of the wick 3, resulting a fact that the heat corresponding to the heat of vaporation has been transmitted.

On the other hand, since the temperature of the heating portion 5 in the heat drive pump 4 can be raised to the same level as that of the heat pipe heating portion, steam bubbles are generated and grow in the liquid receptance portion 6 in the heat drive pump 4. As a result, the suction side stopper valve 10 is closed, while the delivery side stopper valve 11 is opened, causing for the operating liquid corresponding to the volume of the grown steam bubbles to be supplied from the liquid-gas converting chamber 7 to the wick 3 of the heat pipe heating portion via the conducting pipe. When the grown steam bubbles reaches the inside portion of the condensing pipe 8, the heat thereof is taken away by the circumferential portion, and is condensed and the contraction of the same starts. At this time, since the operating liquid retained by the capillary force of the fins 9 cools down the entrance portion of the liquid receptance portion 6, the steam bubbles are completely brought into an contraction process. The operating liquid which has been sufficiently cooled is taken in through the conducting pipe by closing the delivery side stopper valve 11 and by opening the suction side stopper valve 10. That is, the operating liquid accumulated at the cooling portion of the heat pipe is cooled by the return cooler, and is then supplied to the heat drive pump. The water hammer prevention stopper valve 12 is provided for the purpose of relief a high pressure generated by the inertia of the liquid in the conducting pipe when the suction side stopper valve 10 of the heat drive pump is closed and when the delivery side stopper valve is closed.

The operation will now be described depending upon the temperature and the steam pressure of the operating liquid.

Assuming that the temperature and steam pressure of the operating liquid in the heating portion of the heat pipe are $T_1$ and $P_1$, respectively, and similarly assuming that the same in the cooling portion are $T_2$ and $P_2$, the same in the return cooler are $T_3$ and $P_3$, and the same in the liquid-gas converting chamber are $T_4$ and $P_4$, the relationships required to make this device operate normally are established as:

the temperature $T_1 > T_2 > T_4 > T_3$ and the steam pressure $P_1 > P_2 > P_4 > p_3$, wherein $T_1 - T_2$ does not become an excessive level in general. The reason for this lies in that steam can flow without a large resistance. Therefore, a great amount of steam can pass through the heat pipe only by a small steam pressure difference. On the other hand, it is advantageous to make the difference $T_2 - T_3$ great, causing for $P_2 - P_3$ to be also made great. $T_4 - T_3 = a$ is given by the heat drive pump and it becomes substantially constant when the delivery amount of the pump exceeds a certain level. This value $T_4 - T_3 = a$ becomes lower when a further high performance heat drive pump is used. Therefore, when $P_4 - P_3 = b$, steam is first transmitted from the heat pipe heating portion to the cooling portion by the pressure difference $P_1 - P_2$. When the steam bubbles in the heat drive pump is contracted, the pressure difference $P_2 - P_4 = P_2 - (P_3 + b)$ serves as the motive power to raising the operating liquid from the cooling portion up to the liquid-gas converting chamber against pressure $\gamma H$ due to a head H and the fluid pressure $P_D$ due to the conducting pipe or the stopper valve.

That is, the following relationship can be established:

$$\underbrace{P_2 - (P_3 + b)}_{\text{raising pressure}} = \underbrace{\gamma H + P_D}_{\text{resistance pressure}}$$

wherein $\gamma$ represents a specific weight of the liquid.

As can be clearly seen from the above equation, the larger the temperature difference $P_2$ and $P_3$ becomes, the higher the operating liquid can be raised.

As for the position for the return cooler 13, it may be arranged in a conducting pipe from the outlet of the heat pipe cooling portion and the inlet of the heat drive pump or the gas-liquid chamber 7 may be cooled by proper means. However, the position for the return cooler at which the device according to the present invention can exhibit its extreme performance is the position in the vicinity of the outlet of the heat pipe cooling portion.

Figure 2:
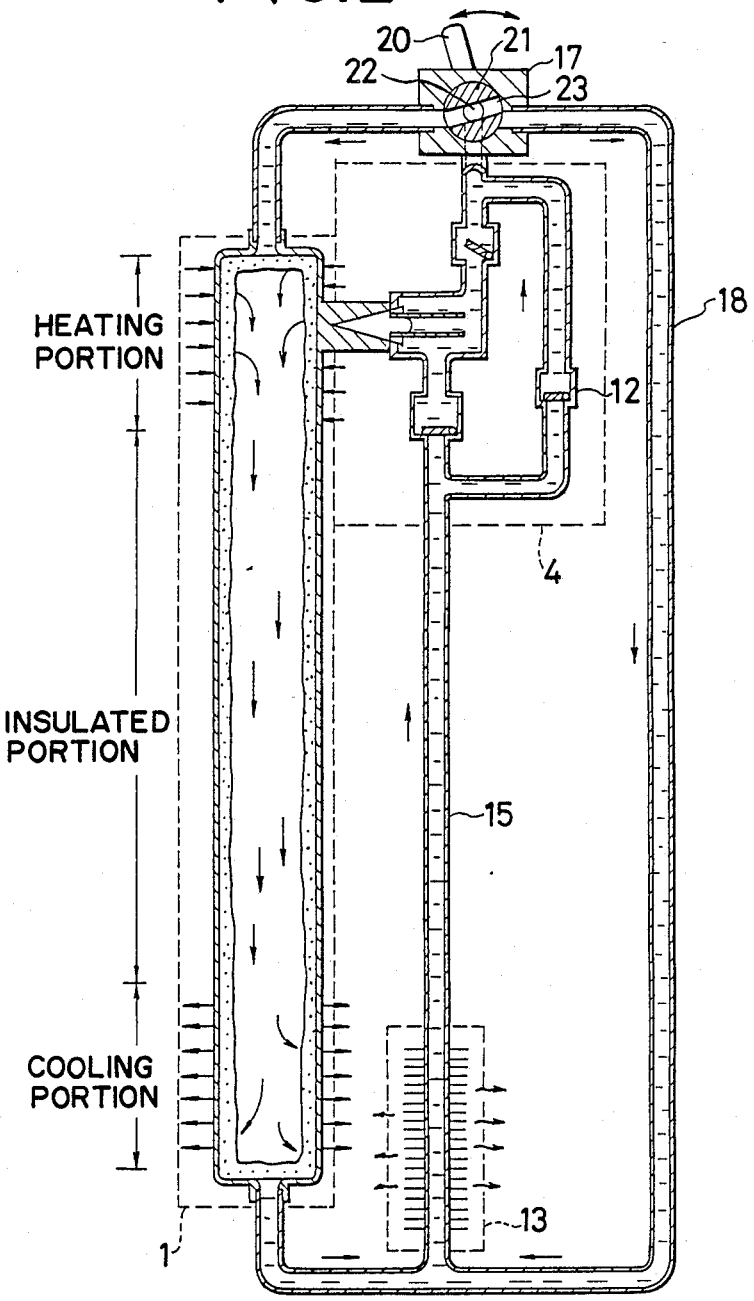
FIGS. 2 and 3 are schematic cross-sectional views of a heat conducting device according to other embodiments.

FIG. 2 illustrates a modification of the present invention. The heat pipe 1, heat drive pump 4, return cooler 13 and the conducting pipe 15 for connecting the former members are similarly provided to the embodiment shown in FIG. 1. In this modification, a flow distribution valve 17 is disposed in the conducting pipe which connects the heat drive pump 4 and the heating portion of the heat pipe 1. The thus-divided conducting pipe 18 through which the operating liquid supplied from the heat drive pump is connected to the inlet of the return cooler.

The flow distribution valve 17 includes a rotary valve 21, as a result of which the operating liquid discharged by the heat drive pump is jetted through an aperture 22 formed at the central portion of this flow distribution valve 17, the thus-jetted operating liquid being then divided into a right flow and a left flow. On the other hand, a rotary valve 21 is rotated by moving a lever 20 so that the engagement areas between the rotary valve 21 and the right and left outlet ports are changed. As a result, the flow of the operating liquid supplied from the heat drive pump to the heat pipe heating portion can be changed from 0% to 100%, that is, the heat conducting performance of the heat pipe can be changed.

On the other hand, the operating fluid which has been divided and introduced into the conducting pipe 18 is, at the inlet of the return cooler, mixed with the operating liquid from the heat pipe so that the thus-mixed operating fluid is cooled down by the return cooler and then returns to the heat drive pump via the conducting pipe 15.

The system in which a divided flow passage is individually provided for the purpose of controlling the flow which passes through the main flow passage including the heat pipe can exhibit the following advantages as:

when the temperature of the heat pipe heating portion is constant, the amount of jetted operating liquid from the heat drive pump becomes constant. Therefore, the amount of jetted operating liquid is free from the affection of the amount of heat transfer through the heat pipe. As a result, the amount of heat transfer can be easily controlled. The heat drive pump can be continuously operated even if the amount of heat transfer through the heat pipe is zero, that is, even if no operating liquid is supplied to the heat pipe. The heat drive pump can always supply the operating liquid to the heat pipe.

Figure 3:
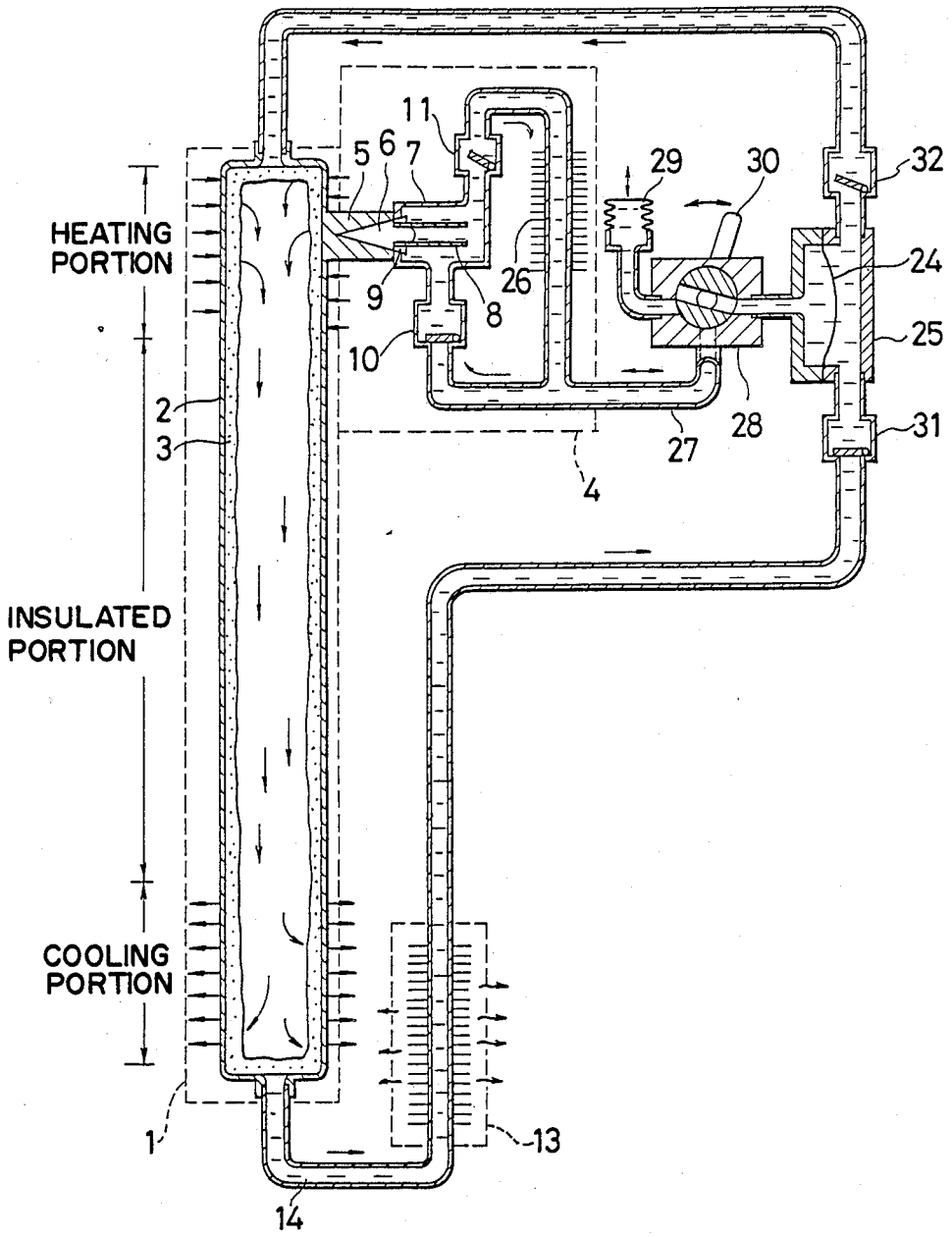

FIG. 3 illustrates another modification of the present invention.

The device according to this modification is arranged in such a manner that liquid which passes through the heat drive pump and liquid which passes through the heat pipe are separated by a diaphragm 24 so that different types of liquid can be individually used. Furthermore, since heat from the heat drive pump is prevented from being transferred to the operating liquid which can act to absorb heat in the heat pipe, the effect of the return cooler can be improved so that a greater steam pressure difference can be generated between the diaphragm 25 and the heat pipe cooling portion.

Heat generated in the heat drive pump 4 radiates outside by a pump radiator 26 included in the heat drive pump 4 so that only the capacity change due to the growth and contraction of the steam bubbles in the receptance portion 6 is introduced from the conducting pipe 27 into the pump flow distribution valve 28. Therefore, division of the capacity change for an accumulator 29 and a diaphragm pump 25 can be performed simply by rotating a lever 30. As a result, the amount of discharge from the diaphragm pump 25 can be changed, and thereby the heat transferring performance of the heat pipe can be changed.

The inlet and outlet of the diaphragm pump is respectively provided with a diaphragm suction stopper valve 31 and a diaphragm delivery stopper valve 32 so that a pumping operation can be achieved.

The operating liquid can comprise the operating liquid used in the heat pipe. Although the heat source of the heat drive pump depends without exception upon the heat pipe heating portion in this embodiment, other heat source may be employed if possible.

Although the wick is laid through the entire inner surface of the heat pipe, the wick may be arranged to be divided into the heating portion and the cooling portion. In the embodiments, the heat pipe is used in a top heat mode without exception, it may be used in a horizontal mode or a reverse mode with no problem. In such cases, the amount of heat transfer can be increased.

According to the present invention, the performance of the heat pipe can be significantly improved. That is, in the conventional heat pipes, the return of the operating liquid to the heating portion completely depends upon the capillary force of the wick. This arises problems when a heat source disposed at a rather higher position is used or when the heat pipe is used to transfer heat over a long distance. However, according to the present invention, since the operating liquid can be returned by the heat drive pump, the operating liquid can be transferred to higher positions or over a long distance. As a result, the above-described problems can be overcome.

Furthermore, although the conventional device utilizes electricity or a centrifugal force for the purpose of returning the operating liquid, the heat can be returned by utilizing the heat in the heating portion in the present invention. Consequently, a simple structured and reliable device can be provided.

What is claimed is:

1. A heat conducting device comprising:

a heat drive pump for pumping a fluid by using growth and contraction of steam bubbles generated by heating a pump operating fluid;

a heat pipe having a heating portion for vaporizing a fluid and a cooling portion for condensing the fluid vaporized by said heating portion and conduit means for fluidly coupling an outlet of said cooling portion to an inlet of said heating portion, said cooling portion having a temperature lower than that of the heating portion, said heat drive pump being operatively coupled to said conduit means for pumping fluid therethrough, and further including a cooler operatively coupled to said conduit means for cooling the fluid condensed in said cooling portion of said heat pipe to a temperature lower than that of said cooling portion, said cooler being disposed between said cooling portion outlet and said operative coupling of said heat drive pump and said conduit means.

2. A heat conducting device accordingly to claim 1, wherein said heat drive pump includes a heat source for heating the pump operating fluid to generate steam bubbles, said heat source of said drive pump being operatively coupled to the heating portion of said heat pipe so as to heat the fluid within said heating portion and to vaporize the same.

3. A heat conducting device according to claim 1, including valve means fluidly coupled to said pump operating fluid for controlling fluid flow through said conduit to said heating portion.

4. A heat conducting device as in claim 3, wherein said pump operating fluid is the fluid vaporized and condensed by said heating portion and said cooling portion, respectively and said heat drive pump is defined in line with said conduit means.

5. A heat conducting device as in claim 4, wherein said valve means divides the fluid flow out of said heat drive pump, a portion of said flow being conducted to said heating portion and a portion of said flow being circulated to an inlet of said cooler.

6. A heat conducting device as in claim 3, wherein said heat drive pump is operatively coupled to said conduit means by a flexible diaphragm element whereby said heat drive pump pumps a pump operating fluid, the pumping of said pump operating fluid deflecting said diaphragm so as to pump fluid flowing through said conduit means.

7. A heat conducting device as in claim 6, wherein said valve means controls the flow of said pump operating fluid so as to control the deflection of said diaphragm.

8. A heat conducting device as in claim 1, wherein said pump operating fluid is the fluid vaporized and condensed by said heating portion and said cooling portion, respectively and said heat drive pump is defined in line with said conduit means.

9. A heat conducting device as in claim 1, wherein said heat drive pump is operatively coupled to said conduit means by a flexible diaphragm element whereby said heat drive pump pumps a pump operating fluid, the pumping of said pump operating fluid deflecting said diaphragm so as to pump fluid flowing through said conduit means.

10. A heat conducting device comprising:

a heat drive pump for pumping a fluid by using growth and contracting of steam bubbles generated by heating a pump operating fluid;

a heat pipe having a heating portion for vaporizing a fluid and a cooling portion for condensing the fluid vaporized by said heating portion and conduit means for fluidly coupling an outlet of said cooling portion to an inlet of said heating portion, said cooling portion having a temperature lower than that of the heating portion, said heat drive pump being operatively coupled to said conduit means for pumping fluid therethrough, said heat drive pump being operatively coupled to said conduit means by a flexible diaphragm element whereby said heat drive pump pumps a pump operating fluid, the pumping of said pump operating fluid deflecting said diaphragm so as to pump fluid flowing through said conduit means.

11. A heat conducting device comprising:

a heat drive pump for pumping a fluid by using growth and contraction of steam bubbles generated by heating a pump operating fluid;

a heat pile having a heating portion for vaporizing a fluid and a cooling portion for condensing the fluid vaporized by said heating portion and conduit means for fluidly coupling an outlet of said cooling portion to an inlet of said heating portion, said cooling portion having a temperature lower than that of the heating portion said heat drive pump being operatively coupled to said conduit means for pumping fluid therethrough; and valve means fluidly coupled to said pump operating fluid for controlling fluid flow through said conduit to said heating portion, said heat drive pump being operatively coupled to said conduit means by a flexible diaphragm element whereby said heat drive pump pumps a pump operating fluid, the pumping of said pump operating fluid detecting said diaphragm so as to pump fluid flowing through said conduit means.

12. A heat conducting device as in claim 11, wherein said valve means controls the flow of said pump operating fluid so as to control the deflection of said diaphragm.

* * * * *